United States Patent [19]

Smith et al.

[11] Patent Number: 5,041,003

[45] Date of Patent: Aug. 20, 1991

[54] ELECTRICAL CONNECTOR SYSTEM

[75] Inventors: Robert T. Smith, Round Rock, Tex.; Chang-Hwa Chung, San Jose, Calif.; Yu C. Chang, Austin, Tex.

[73] Assignee: Microelectronics and Computer Technology Corporation, Austin, Tex.

[21] Appl. No.: 558,936

[22] Filed: Jul. 27, 1990

Related U.S. Application Data

[63] Continuation-in-part of Ser. No. 389,927, Aug. 4, 1989, abandoned.

[51] Int. Cl.[5] ..... H01R 13/629

[52] U.S. Cl. ..... 439/259; 174/117 FF; 439/329

[58] Field of Search ..... 439/62, 67, 259, 261, 439/325, 327, 329, 493, 695; 174/117 F, 117 FF

[56] References Cited

U.S. PATENT DOCUMENTS

| | | | |
|---|---|---|---|
| 4,152,826 | 5/1979 | Mueller | 29/624 |
| 4,226,492 | 10/1980 | Deo et al. | 339/17 |
| 4,235,500 | 11/1980 | Belopavlovich et al. | 339/176 |
| 4,402,563 | 9/1983 | Sinclair | 339/75 |
| 4,420,206 | 12/1983 | Martyniak | 339/75 |
| 4,517,625 | 5/1985 | Frink et al. | 361/399 |
| 4,577,918 | 3/1986 | Kasdagly | 339/17 |
| 4,583,800 | 4/1986 | Roberts et al. | 339/17 |
| 4,616,102 | 10/1986 | Noorily | 174/36 |
| 4,636,019 | 1/1987 | Gillett et al. | 339/17 |
| 4,647,125 | 3/1987 | Landi et al. | 339/17 |
| 4,798,918 | 1/1989 | Kabadi et al. | 174/36 |
| 4,895,523 | 1/1990 | Morrison et al. | 439/67 |
| 4,907,975 | 3/1990 | Dranchak et al. | 439/67 |

OTHER PUBLICATIONS

K rug, "Designing a High Density Backplane Interconnect System", Connection Technology, Apr. 1988, pp. 26–30.

Smolley, "Button Board a New Technology Interconnect", Proceedings of the Fourth Annual International Electronics Packaging Conference, 1984, pp. 75–91.

Weber, "PC Board Suppliers Look for Material and Design Gains", Electronics, Oct. 1988, pp. 107–109.

Buchoff, "Elastomeric Connectors for Land Grid Array Packages," Connector Technology, Apr. 1989, pp. 15–18.

Buchoff et al., "Solutions for Dense Packaging Challenges," Proceedings of the Seventh Annual International Elec. Packaging Conference, 1987, pp. 601–611.

Yasumura, "High-Speed ZIF Connectors Use Shape Memory Alloys and Flexible Circuits", Connection Technology, 1987, pp. 40–44.

Simpson, "A Connection System with High Contact Density and Controlled Impedance", Connection Technology, Aug. 1989, pp. 35–40.

Simpson, "INVISICON ®, The Invisible Interconnection TM-A Connection System with High Contact Density and Controlled Impedance", Rogers Corporation Sales Brochure.

Chung et al., "High Performance High Density Connectors Utilizing Multiple Layer Metal/Polymer Construction" Proceedings of the 37th Electronic Components Conference, 1987, pp. 11–18.

Smith et al., "High Performance High Density Connections Utilizing Multiple Layer Metal/Polymer Construction," Proceedings of the 38th Electronic Components Conference, 1988, pp. 226–233.

(List continued on next page.)

*Primary Examiner*—Eugene F. Desmond

*Attorney, Agent, or Firm*—Fulbright & Jaworski

[57] ABSTRACT

An electrical connector having first and second coacting engagable parts for mating a plurality of spaced electrical contacts in which the system includes predictable alignment, contact force and wiping features. The connector may use flexible circuit tape as the contact elements in which a plurality of modules may be utilized to be aligned separately to avoid cumulative alignment errors. The flexible circuit tape may be a TAB type tape which is configured to allow the end user with the capability to program the signal/ground ratio of the interconnect.

23 Claims, 11 Drawing Sheets

OTHER PUBLICATIONS

Lambert et al., "Use of Anisotropically Conductive Elastomers in High Density Separable Connectors," Proceedings of the 39th Electronic Components Conference, 1989, pp. 99–106.

Weeks, "Multiconductor Transmission-Line Theory in the TEM Approximation," IBM Journal of Research Development, Nov., 1972, pp. 604–611.

Fjelstad, "Design Guidelines for Flexible Circuits," Electronic Packaging and Production, Aug., 1988, pp. 32–34.

Holm, "Electric Contact, Theory and Application," 4th Edition, Springer-Verlag, New York, 1967, p. 124.

Holm, "Electric Contact, Theory and Application," 4th Edition, Springer-Verlag, New York, 1967, p. 328.

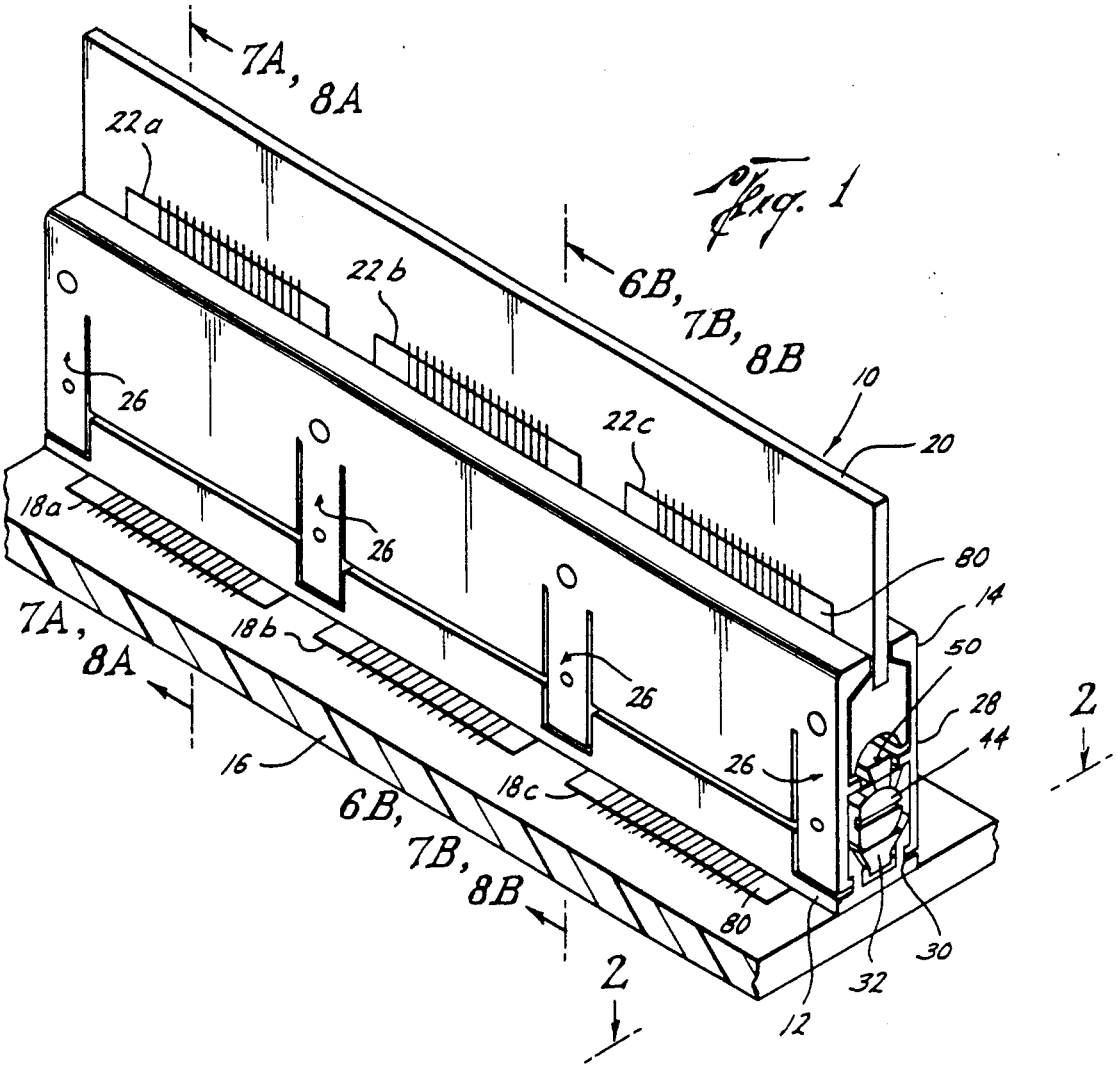
Fig. 1
Fig. 2
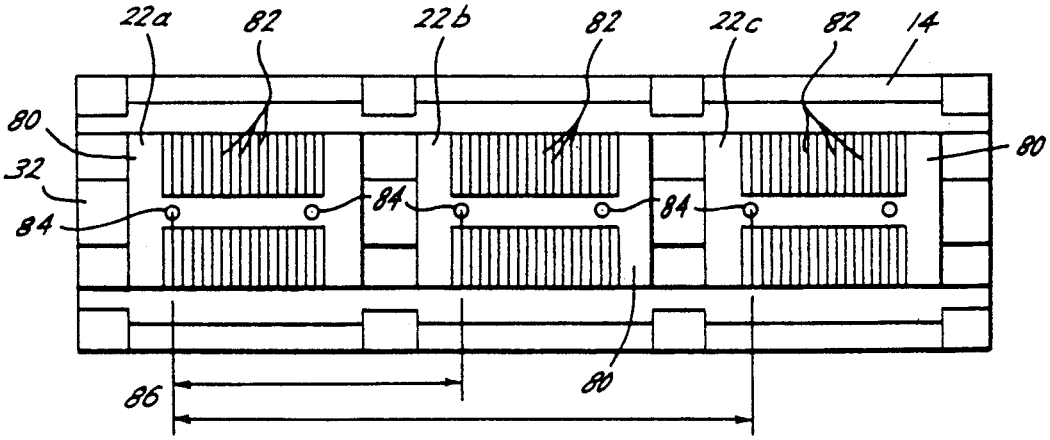

28
28
50
52
56
44
58
60
54
14
52
32
58
36
60
24
40
30
12
30
40
23

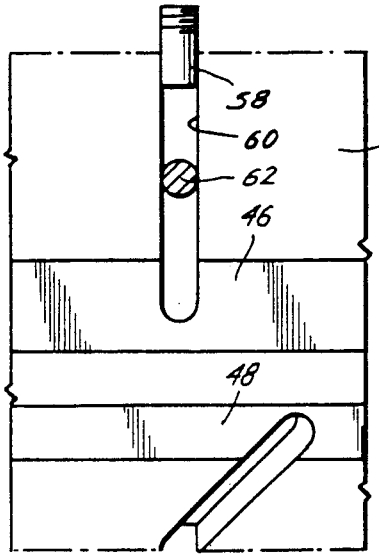
Fig. 7C
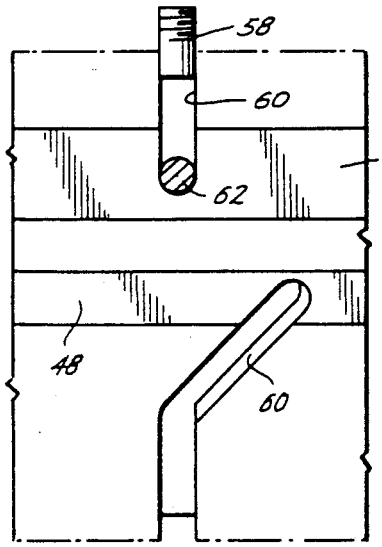
Fig. 8C
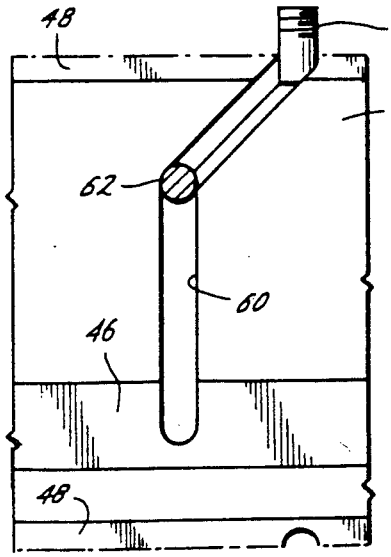
Fig. 6C
Fig. 4
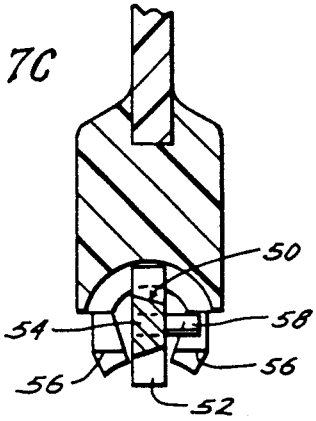
Fig. 5
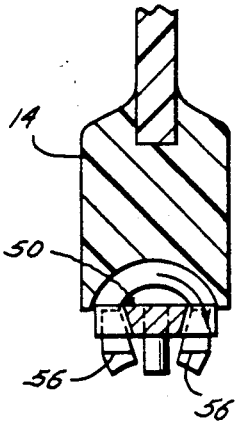
Fig. 6B
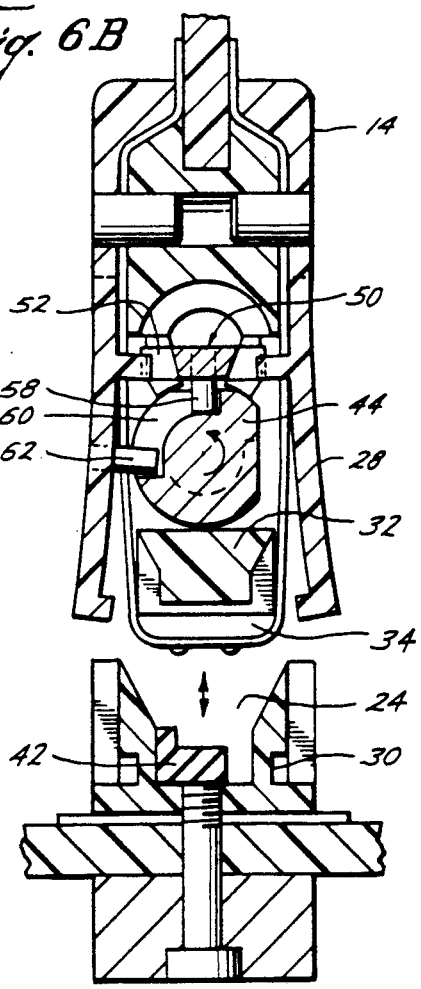

10c
14c
30c
74
76
44c
74
46c
48c
x
76
32c
84
x
28c
72
24c
12c
70

18

14c
22a
46c
44c
48c
32c
23c
12c
34c
18a
18

14c
30c
74
28c
44c
32c
12c 16A,17A,19A
16B,17B,19B
14c
44c
74
46c
32
25
27
16A,17A,19A
16B,17B,19B

ELECTRICAL CONNECTOR SYSTEM

CROSS REFERENCE TO RELATED APPLICATIONS

This application is a continuation in part of U.S. Ser. No. 07/389,927, filed Aug. 4, 1989, entitled Electrical Connector System, now abandoned.

BACKGROUND OF THE INVENTION

The present invention relates to an electrical connector system for connecting and disconnecting a plurality of electrical contacts for providing an electrical interconnect The connector includes first and second coacting engagable and releasable longitudinally extending parts, each of which includes a plurality of spaced electrical contacts for interconnection. The connector system advantageously provides predictable alignment of the coacting contacts, optimum contact force, and contact wiping upon connection. The present connector is particularly useful in using a modular flexible circuit tape as one or both of the contact containing elements. The use of flexible tapes as contacts as interconnect means allows the tape to be placed in a plurality of modules containing electrical contacts for overcoming tolerance variations such as thermal coefficient of expansion by reducing cumulative alignment errors. The use of the flexible tape-automated-bonded (TAB) tape also provides an interconnect in which the end user may easily program the signal/ground ratio.

SUMMARY

The present invention is directed to an electrical connector having first and second coacting engagable and releasable longitudinally extending parts in which each of the parts includes a plurality of spaced electrical contacts for connection to the contacts on the other part. The connector includes a latching and unlatching mechanism connected between the first and second parts and positioned on each side of the plurality of contacts for providing a uniform contact force over the plurality of interconnecting contacts. The mechanism includes latching arms on one part and latch shoulders on the other part. A longitudinally extending loading and wiping block extends through the second part adjacent the electrical contacts on the second part and extends through the latching and unlatching mechanisms. Coacting incline surfaces are provided in the latching and unlatching mechanism between the loading and unloading block and the first connector part for moving the block transversely as it is moved towards the contacts for providing a wiping action between engaging contacts. Rotatable cam means are provided between the block and the second part for moving the block towards the contacts for providing a predictable contact force. And release means are provided engagable with and unlatching the latch arms from the latch shoulders for disconnecting the first and second connector parts.

Still a further object of the present invention is wherein the release means includes a release wedge and the cam means includes first and second cam surfaces, one of the surfaces controls the movement of the loading and wiping block, and the second of the surfaces controls the movement of the release wedge.

Yet a still further object of the present invention is the provision of biasing means positioned between the first part and the loading and wiping block for biasing the coacting incline surfaces together for creating a wiping action between the contacts on the first and second parts.

Still a further object of the present invention is wherein the electrical contacts include a flexible tape having an insulating layer and a plurality of contacts. Preferably, the flexible tape on the second part extends around the loading and wiping block and is attached to opposite sides of the second part.

Another object of the present invention is wherein the plurality of modules formed from each of the parts includes a plurality of electrical contacts, wherein each module includes one or more flexible tapes having an insulating and a metal contact layer. Each set is provided with independent alignment reference point on its connected part for avoiding cumulative alignment errors.

Yet a further object of the present invention is wherein each of the spaced modules containing electrical contacts includes a flexible electrical tape having three layers, the first layer including a plurality of electrical traces, the second layer is the middle layer and includes an insulator, and the third layer includes a ground plane or layer. A connection is provided between alternate traces through a via in the insulator to the ground layer. The connection to the ground layer is in the third layer and includes a portion offset from the ground layer. In addition, the connection to the ground layer may include a portion offset from the electrical traces.

A further object is wherein the release means includes a longitudinally extending wedge member movable in a longitudinal direction for simultaneously releasing all of the latch arms.

Yet a further object is the provision of an electrical connector including first and second coacting engagable and releasable longitudinally extending parts, said first part having an opening for receiving said second part. The first part includes a window in which is positioned a plurality of spaced electrical contacts. The second part includes a plurality of spaced electrical contacts extending around the bottom of the second part and attached to opposite sides of the second part. The contacts on the second part are positioned to engage the contacts on the first part when the second part is positioned in the opening of the first part. A latching and unlatching mechanism, including latching arms and latching shoulders, is connected between the first and second parts and positioned on each side of the plurality of contacts. A wiping block extends through the second part against the electrical contacts on the second part and extends through the latching and unlatching mechanisms. Coacting incline surfaces between the loading and unloading block and the first part, in the latching and unlatching mechanisms, are provided for moving the block in a wiping action as the contacts on the first and second parts are engaged. Rotatable cam means are provided between the block and the second part for moving the block towards the contacts and release means are engagable with and unlatch the latching arms.

Other and further objects, features and advantages will be apparent from the following description of presently preferred embodiments of the invention, given for the purpose of disclosure and taken in conjunction with the accompanying drawings.

BRIEF DESCRIPTION OF THE DRAWINGS

FIG. 1 is an elevational, perspective view of one form of the electrical connector of the present invention showing a plurality of modules, each containing a plurality of electrical interconnection contacts, FIG. 2 illustrates the position of a plurality of modules of flexible tape electrical contacts on the second part, as viewed from the upper surface of the first part, for avoiding tolerance variations in the individual tape modules, FIGS. 4 and 5 are enlarged fragmentary, cross-sectional views illustrating the insertion of the release means in the second part of the connector, FIG. 6B is an enlarged, cross-sectional view taken along the line 6B—6B of FIG. 1 illustrating the connector in the released position, FIG. 6C is a development view of the position of the cam surfaces of the cam illustrated in FIG. 6B, FIG. 7C is a development view of the cam position of FIG. 7B, FIG. 8C is a development view of the position of the cam in FIG. 8B.

DESCRIPTION OF THE PREFERRED EMBODIMENTS

Figure 3:
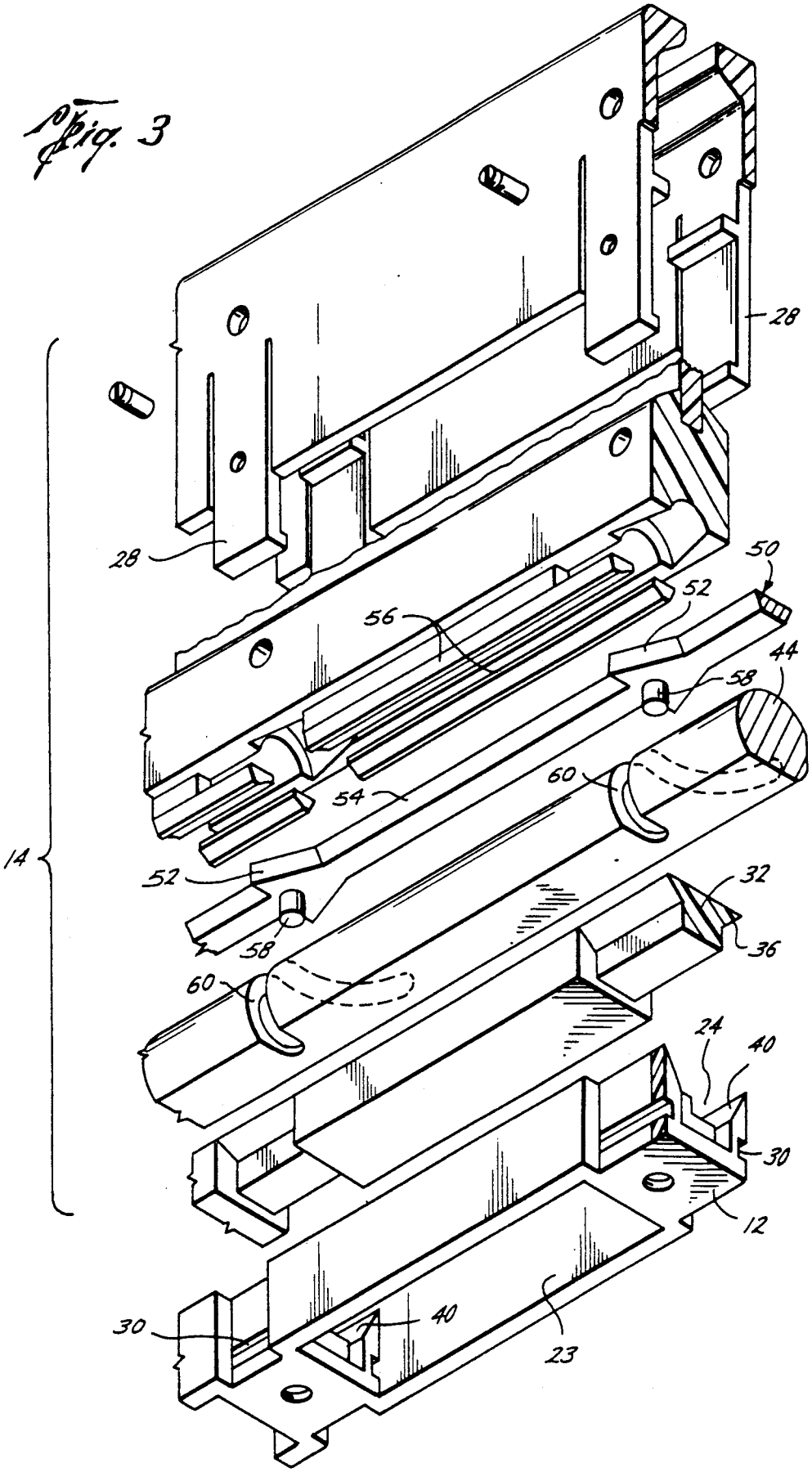
FIG. 3 is an exploded perspective view of one of the module of FIG. 1 omitting the interconnecting tapes and the electrical contacts.

Referring now to FIGS. 1-8, the electrical connector of the present invention is generally indicated by the reference numeral 10 and generally includes a first part 12 and a second part 14 which are coacting engagable and releasable longitudinal extending parts. Each of the parts 12 and 14 include a plurality of spaced electrical contacts for connection to the contacts on the other parts. For example, the part 12 may include a mother board 16 having a plurality of modules **18*a*, 18*b* and 18*c*, preferably of a flexible circuit tape such as TAB tape overlay on the surface of motherboard 16, wherein each module contains a plurality of electrical contacts. Optionally, the electrical contacts within modules 18*a*, 18*b* and 18*c* can be incorporated directly on the surface of the motherboard 16. Similarly, the second part 14 may include a daughter board 20 having a plurality of modules, wherein each module contains a plurality of electrical contacts such as flexible circuit tapes 22*a*, 22*b* and 22. As best seen in FIG. 3, the first part 12 includes a window 23 in which each of the modules 18*a*, 18*b* or 18*c* containing electrical contacts are separately positioned. The first part 12 includes an opening 24 for receiving the lower portion of the second part 14. Each of the modules 22*a*, 22*b* and 22*c* of the electrical contacts, as best seen in FIGS. 7A and 8A extend around the bottom of the second connector part 14, with a slight amount of slack therein, and are connected on opposite sides in the part 12. Thus, when the second part 14 is inserted into the opening 24 of the first part 14, the electrical contacts on the second part 12 are positioned adjacent the electrical contacts on the first part 12** for engagement.

A latching and unlatching mechanism 26 is connected between the first part 12 and the second part 14 and positioned on each side of the sets **22*a*, 22*b* and 22*c*. The mechanism 26 includes latching arms 28 on one part, here shown as part 14, and latch shoulders 30 on the other part, here shown as part 12**.

A longitudinally extending loading and wiping block 32 extends through the second connector part 14 adjacent the modules 22a, 22b and 22c, and also extends through the latching and unlatching mechanism 26. At the locations in which the block 32 extends through the modules 22a, 22b and 22c of electrical contacts, as best seen in FIGS. 7A and 8A, the block 32 may be rectangular in cross-section, and a resilient pad 34 is provided between the block 32 and the modules 22a, 22b and 22c.

In the latching and unlatching mechanism stations 26, the block 32 is provided with an incline surface 36 (FIGS. 3, 7B, and 8B) which coacts with an incline surface 40 on the first part 12. Thus, as the block 32 moves downwardly to bring the electrical contacts on the second part 14 due to flexible slack in the flexible tapes 22a, 22b, and 22c, into engagement with the electrical contacts on the first part 12, the inclined surfaces 36 and 40 will engage causing the block 32 to move transverse to the longitudinal axis of the connector 10 to provide a wiping action between the contacts on part 12 with the electrical contacts on second part 14. A biasing means such as resilient elastomer 42 is provided in the connector part 12 for engagement with the block 32 for biasing the incline surfaces 36 and 40 together for creating a wiping action between the electrical contacts on the first part 12 and the second part 14.

Figure 7A:
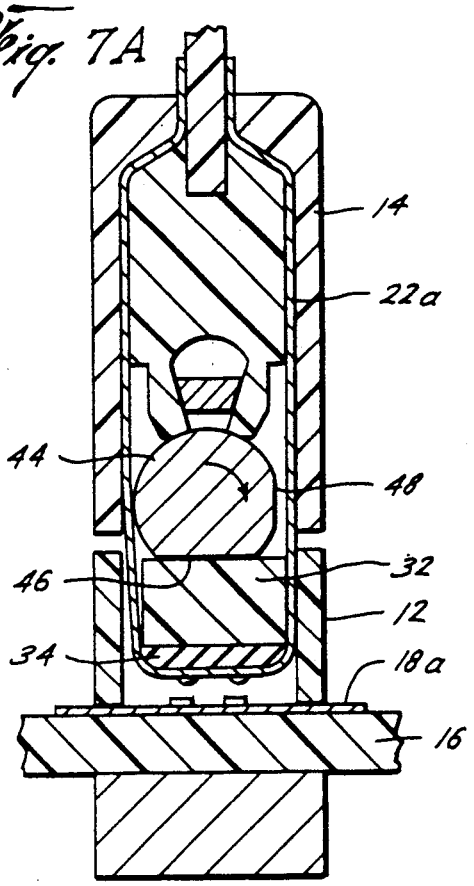
FIG. 7A is an enlarged, cross-sectional view taken along the line 7A—7A of FIG. 1, with the connector in the latched position without the coacting electrical contacts engaged.
Figure 7B:
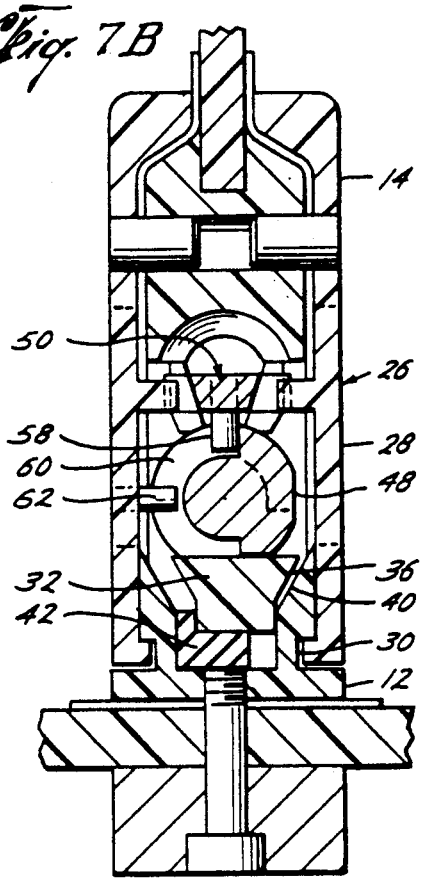
FIG. 7B is an enlarged, cross-sectional view taken along the line 7B—7B of FIG. 1 in which the latching and unlatching mechanism is engaged and in the same position as FIG. 7A.
Figure 8A:
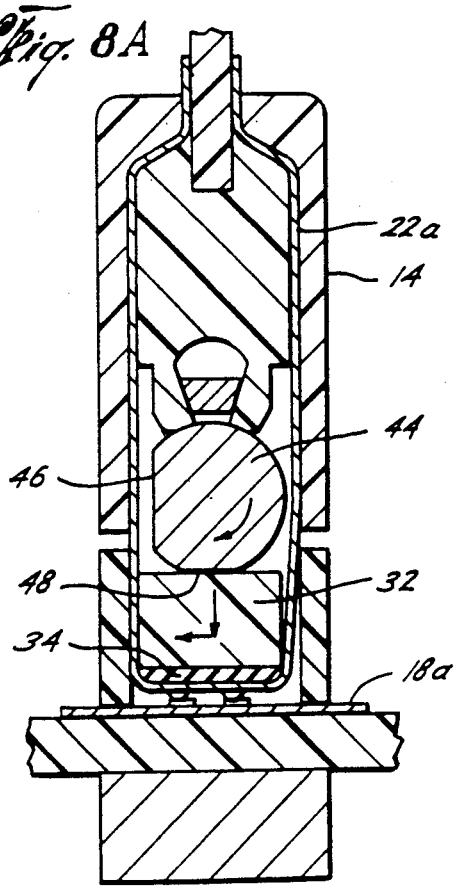
FIG. 8A is an enlarged cross-sectional view taken along the line 8A—8A of FIG. 1 in which the electrical contacts of the parts of the connector have been engaged.
Figure 8B:
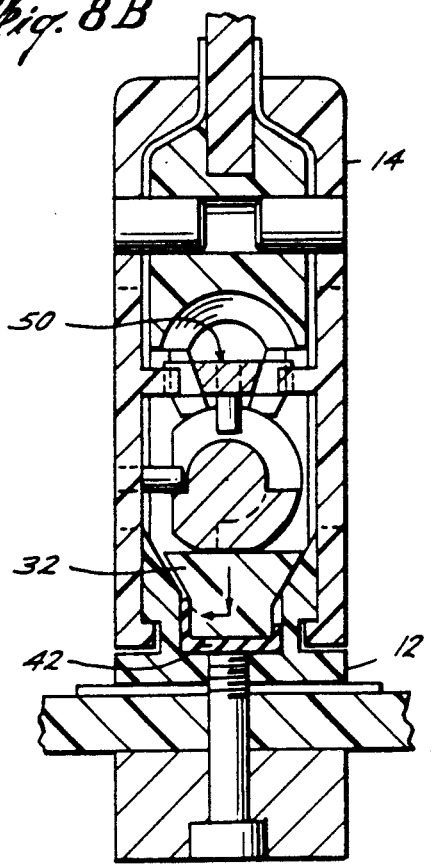
FIG. 8B is an enlarged cross-sectional view taken along the line 8B—8B of FIG. 1 showing the latching and unlatching mechanism in the same position as the parts in FIG. 8A.
Figure 9:
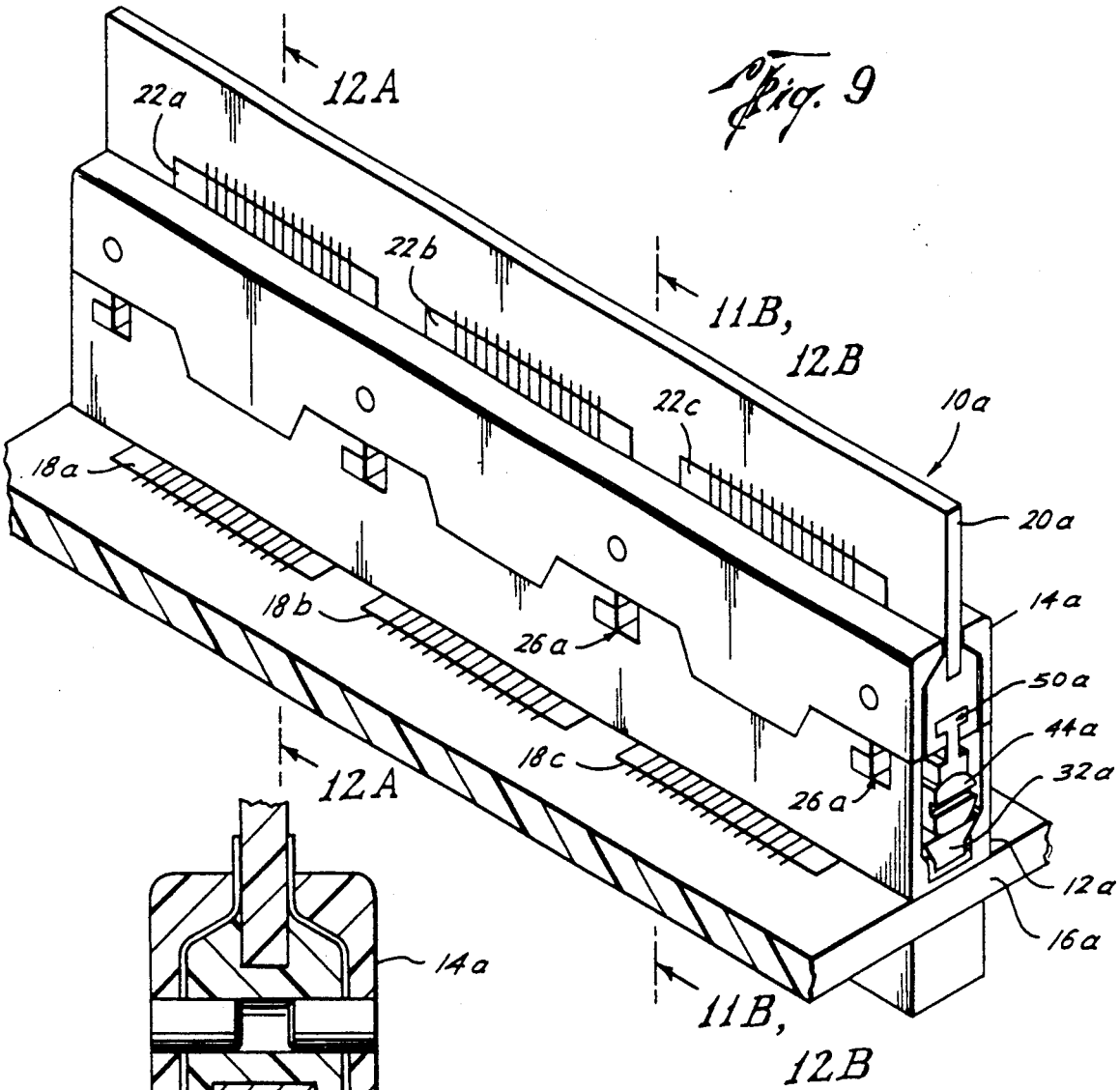
FIG. 9 is an elevational perspective view of another form of the electrical connector of the present invention.
Figure 11B:
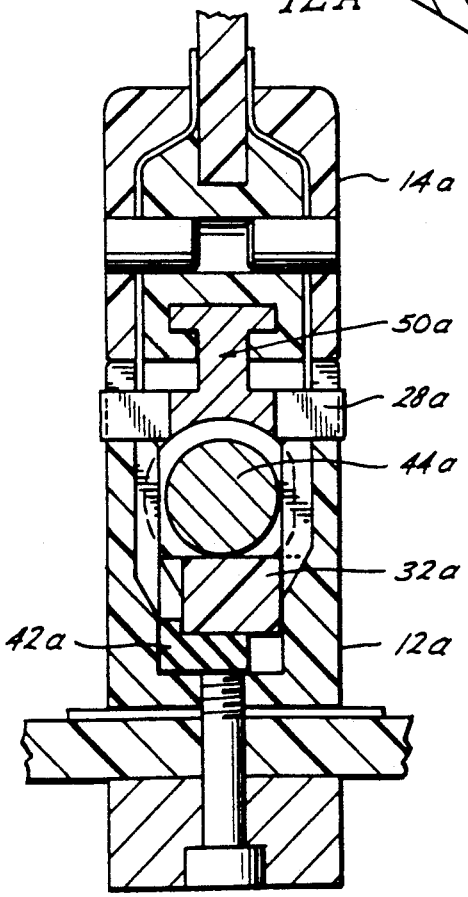
FIG. 11B is a cross-sectional view taken along the line 11B—11B of FIG. 9 illustrating the latching and unlatching mechanism in the engaged position with the electrical contacts unengaged.
Figure 10:
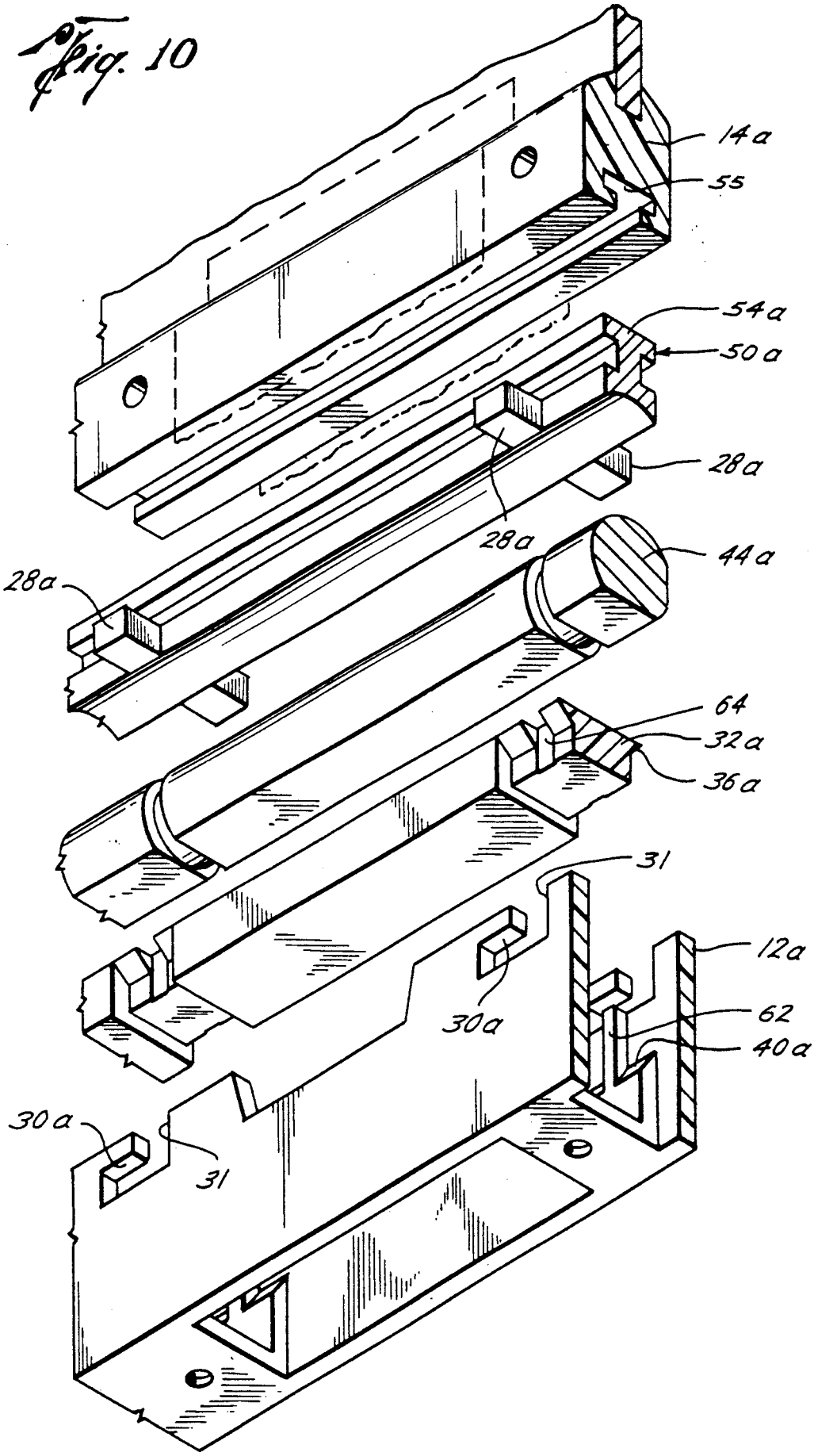
FIG. 10 is an exploded perspective view of the connector of FIG. 9, omitting the electrical contacts.
Figure 12A:
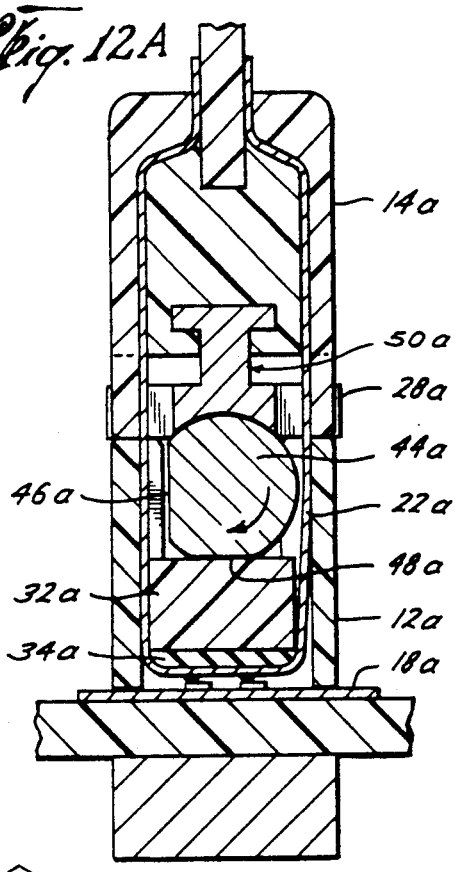
FIG. 12A is a cross-sectional view taken along the line 12A—12A of FIG. 9 showing the connector engaged with the electrical contacts of both parts engaged.
Figure 12B:
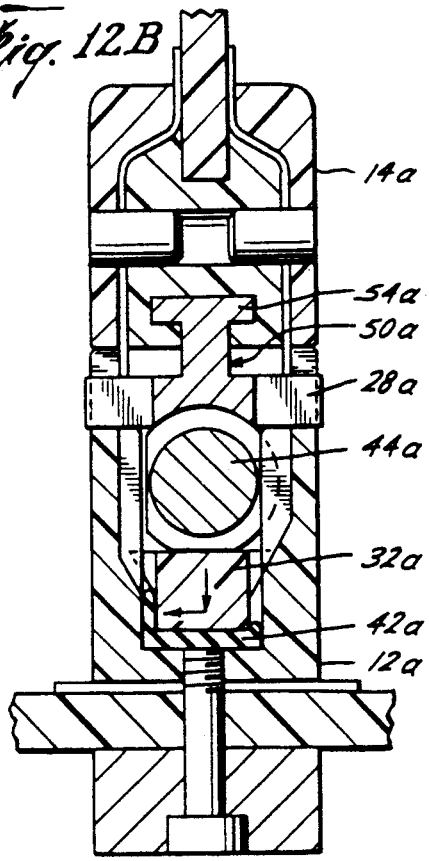
FIG. 12B is a cross-sectional view taken along the line 12B—12B of FIG. 9 illustrating the latching and unlatching mechanism in the fully latched and engaged position.

Rotatable cam means 44 are provided between the loading and wiping block 32 and the second part 14 for moving the block 32 towards the first part 12 when the parts 12 and 14 are engaged thereby bringing the electrical contacts on the second part 14 into a wiping engagement with the electrical contacts on the first part 12 As best seen in FIGS. 7A and 7B, the second connector part 14 is latched into the first connector part 12 by the latching arms 28 engaging the latching shoulders 30, but the electrical contacts are not in engagement. The cam 44 has a flat cam surface 46 and, if desired, a second greater radially distant flat cam surface 48. Initially, the first surface 46 is in engagement with the top of the block 32 allowing the block 32 and the electrical contacts on the part 14 to be in a retracted position. However, when the cam 44 is rotated in the clockwise position, the block 32 is displaced downwardly by the portion of the cam surface 46 causing the incline surfaces 36 and 40 to engage. This causes the block 32 to move both downwardly and transversely to provide a wiping action of the electrical contacts in the flexible slacken modules 22a, 22b 22c of part 14 relative to the contacts in the modules 18a, 18b and 18c of part 12. When the cam 44 is rotated 90 degree, the flat surface 48, if used, is brought into a locking engagement with the top of the block 32 holding the engaging electrical contacts in a locked position.

The connector 10 provides a predictable contact force and wiping feature. When the connector parts 12 and 14 are joined, the block 32 is pushed by the cam 44 against the incline surface 40. The block 32 carries the electrical contacts in the modules 22a, 22b and 22c and provides a horizontal displacement or wiping due to the vertical or downward displacement of the block 32. The amount of the horizontal displacement is defined by the angle of the incline surfaces 36 and 40 and the amount of the vertical displacement.

Referring now to FIGS. 1 and 3–8B, release means, generally indicated by the reference numeral 50, are provided which are engagable with and unlatch the latching arms 28 from the latch shoulders 30 for releasing the second connector part 14 from the first connector part 12. The release means 50 includes wedge surfaces 52 at spaced intervals along a longitudinal rod 54 for engaging each of the latching arms 28. The rod 54 is carried in tracks 56 for longitudinal movement. The bar 54 and wedges 52 are inserted into the tracks 56 as best seen in FIGS. 4 and 5 by inserting the rod 54 in a vertical plane where they are then rotated 90 degrees to place them in a horizontal plane supported by the tracks 56. While the rod 54 may be moved longitudinally, independently from the cam 44, the rod 54 may be connected to the cam 44 by pins 58, movable in cam slots 60 in the cam 44 for providing longitudinal movement of the releasing mechanism 50 by actuation of the cam 44. However, in order that the cam 44 not move in a longitudinal direction as it is rotated, a pin 62 is provided in the second part 14 and the pin 62 engages the slot 60 to prevent the cam 44 from longitudinally moving as it is rotated. As shown in FIGS. 6B, 7B, 8B, 6C, 7C and 8C, the pin 62 remains in the transverse section of the cam slot 60 at all times. However, as the cam 44 is rotated counterclockwise, the pin 58 connected to the release means 50 moves into the offset portion of the cam slot 60 to move the release means 50 longitudinally to cause the wedges 52 to engage the insides of the arms 28 as best seen in FIG. 6B to release them from the latching shoulders 30 in the first connector part 12.

Figure 13:
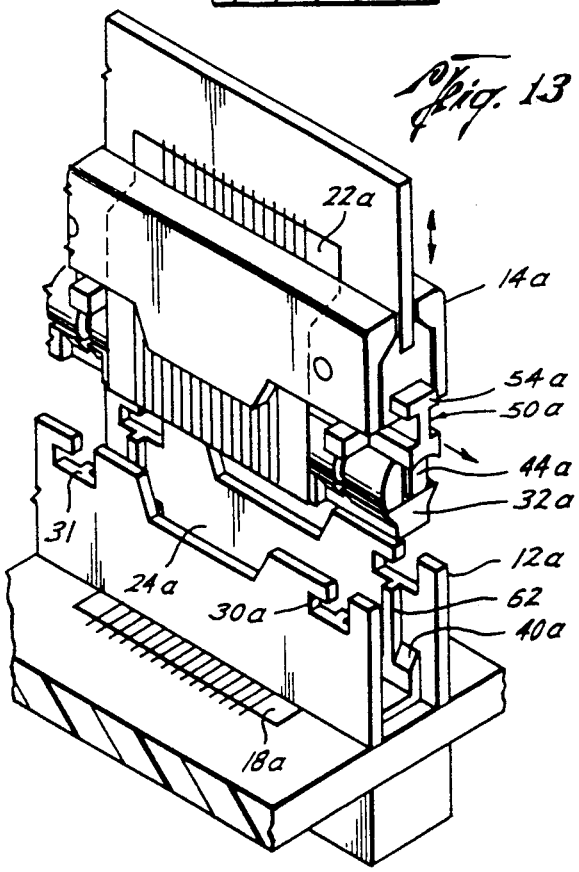
FIG. 13 is a fragmentary, elevational exploded perspective view showing the operation of the latching and unlatching mechanism.
Figure 14:
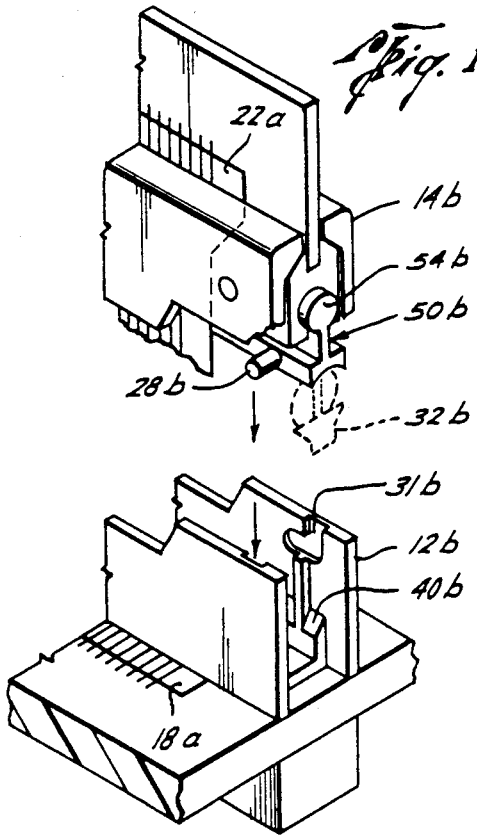
FIG. 14 is a view similar to FIG. 13 showing a modified latching and unlatching mechanism.

Various other embodiments of the invention may be provided and wherein like parts are similarly numbered with the addition of the suffix "a" in the embodiment of FIGS. 9–13, the suffix "b" for the modification of FIG. 14, and the suffix "c" for the embodiment of FIGS. 15–19, with the exception that modules 18a, 18b, 18c, 22a, 22b and 22c refer to separate modular pluralities of electrical contacts in each embodiment herein.

Referring now to FIGS. 9–13, the connector 10a includes a first part 12a for receiving a second part 14a whereby modules 22a, 22b and 22c containing electrical contacts on second part 14a may be engaged and released from the modules 18a, 18b and 18c containing electrical contacts on first part 12a. Connector 10a includes a longitudinally extending loading and wiping block 32a and coacting incline surfaces 36a and 40a are provided in the latching and unlatching mechanisms 26a between the loading and unloading block 32a and the first part 12a for moving the first plurality of flexible and slacked modules 22a, 22b and 22c containing electrical contacts into an engaged and wiping contact with the modules 18a, 18b and 18c on part 12a. Rotatable cam means 44a is provided between the block 32a and the second part 14a for moving the block 32a towards the electrical contacts. The foregoing portions of connector 10a are similar to those previously described in the description of connector 10. However, the latching and unlatching mechanism 26a and the release means 50a form a different embodiment for connecting and releasing the connector part 14a from the connector part 12a. The latching and unlatching mechanism includes latching arms 28a on Part 14a which are engagable with and releasable from latch shoulders 30a which are formed on the first part 12a. The release means 50a includes a rod 54a of T-shaped cross-section which is longitudinally movable in a groove 55 and carries the latching arms 28a. Longitudinal movement of the shaft 54a allows the arms 28a to be inserted into a slot 31 in the first part 12a and actuated to engage the latch shoulders 30a. Longitudinal movement releases the latching arms 28a from the latch shoulders 30a.

In the embodiment of FIGS. 9–13, longitudinal alignment between the connector parts 12a and 14a are provided by coacting ribs 62 and grooves 64 in the second part 14a.

Referring to FIG. 14, a modification of the embodiment of FIG. 13 is shown in which the release bar 50b includes a circular cross-section rod 54b for reducing friction and the slots 31b in the first member 12b are engaged by a circular latching arm 28b which does not go entirely through the wall of part 12b thereby providing greater strength.

Figure 15:
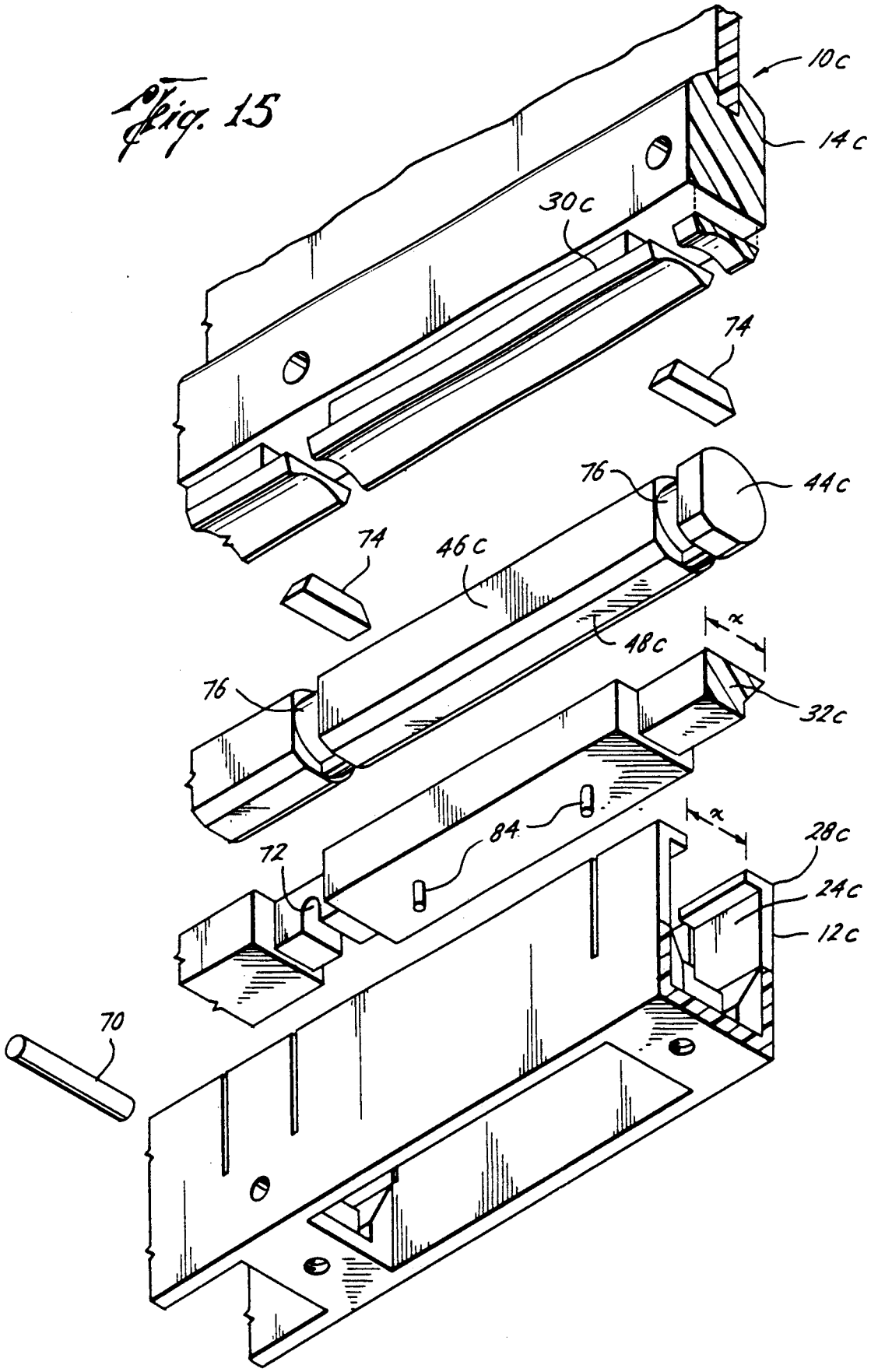
FIG. 15 is a fragmentary, exploded perspective view of still a further form of the electrical connector of the present invention.

In the embodiment of FIGS. 15 through 19, the first connector part 12c includes an opening 24c for receiving the second connector part 14c for bringing the flexible and slacked modules 22a, 22b and 23c containing electrical contacts into engagement with the modules 18a, 18b and 18c containing electrical contacts on the first part 12c. Again, a longitudinally extending loading and wiping block 32c is actuated by a cam 44c and utilizes incline surfaces 36c and 40c for providing a wiping and engaging force between the coacting electrical contacts. In this case, the latching and unlatching mechanism 26c includes latching arms 28c on the first part 12c and latching shoulders 30c on the second connector part 14c. The parts 12c and 14c are engaged by the mere insertion of the second part 14c into the first part 12c allowing the flexible latching arms 28c to engage and lock on the latch shoulders 30c. Longitudinal alignment of the parts 12c and 14c is accomplished by a pin 70 on part 12c engaging a slot 72 on part 14c, as best seen in FIG. 15. Operation of the cam 44c, when the parts 12c and 14c are engaged, in a clockwise direction rotates the smaller diameter flat 46c out of position shown in FIG. 16A to bring greater diameter flat 48c into a locking position against the back of the block 32c, as best seen in FIG. 17A. This places the electrical contacts of the modules 21a, 22b and 22c in engagement with the electrical contacts on modules 18a, 18b and 18c. Similarly, rotation of the cam 44c moves the block 32c from the retracted position in FIG. 16B to the wiping, force holding and locking position shown in FIG. 17B. This structure and operation is generally similar to the embodiments previously described.

Figure 16A:
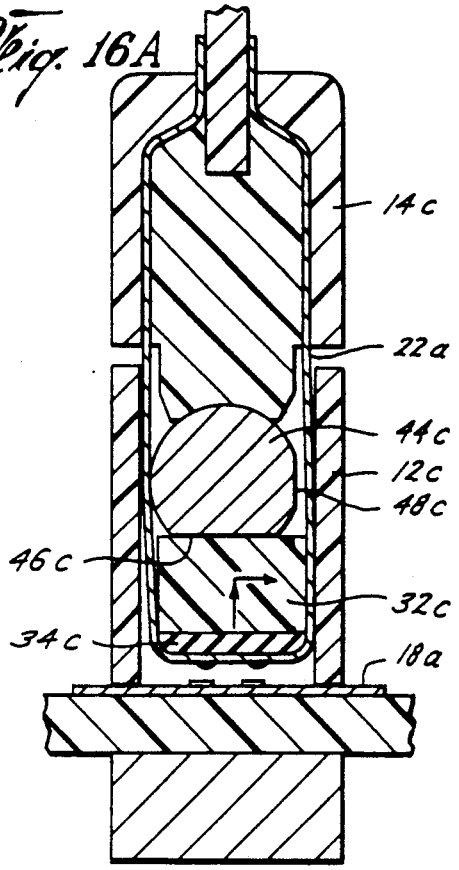
FIG. 16A is a cross-sectional view taken along the line 16A—16A of FIG. 18 showing the connector in the engaged position, but without the electrical contacts engaged.
Figure 16B:
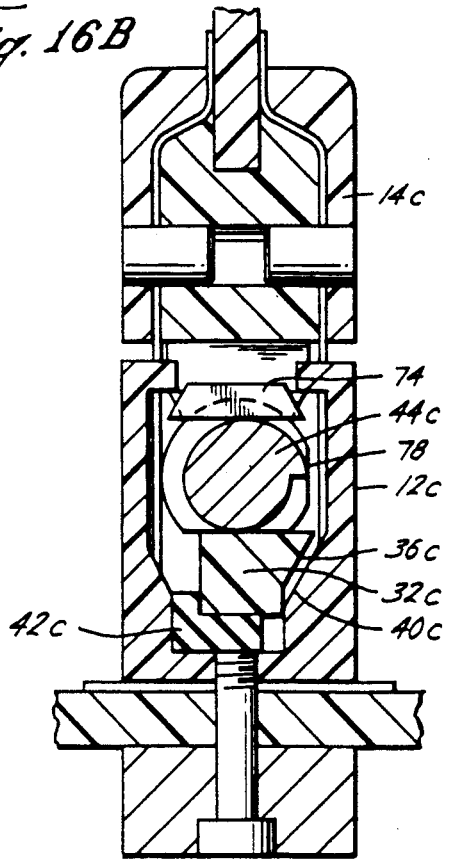
FIG. 16B is a cross-sectional view taken along the line 16B—16B of FIG. 18 showing the latching and unlatching mechanism in the same position as the parts in FIG. 16A.
Figure 19A:
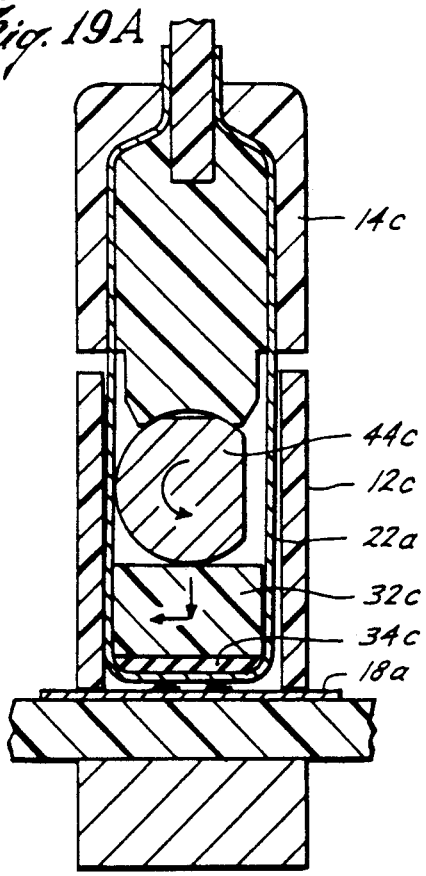
FIG. 19A is a cross-sectional view taken along the line 19A—19A of FIG. 18 showing the connector engaged and the electrical contacts engaged.
Figure 19B:
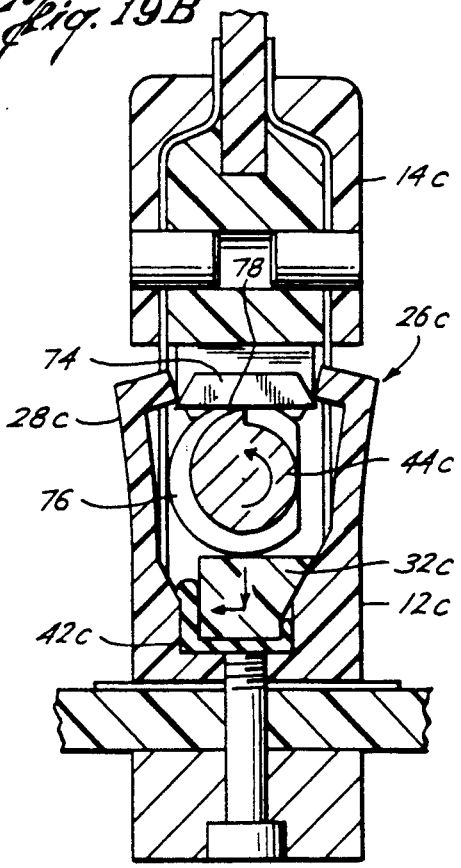
FIG. 19B is a cross-sectional view, taken along the line 19B—19B with the latching and unlatching mechanism shown in the unlatched position.
Figure 17A:
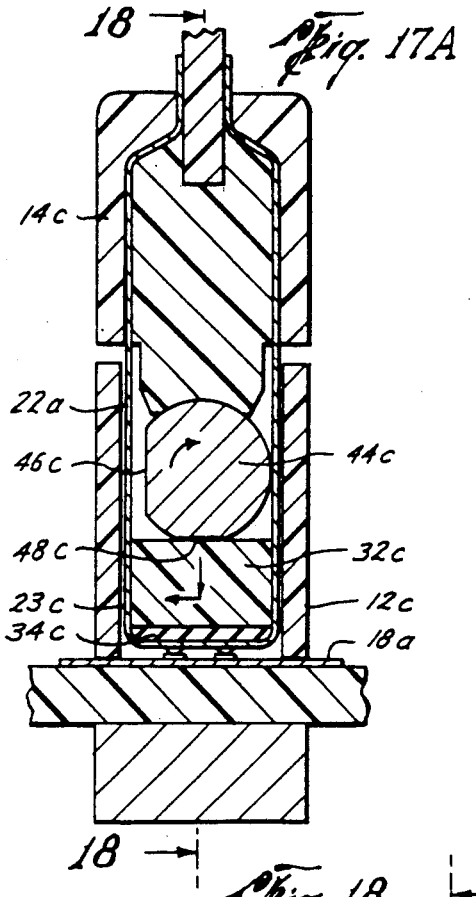
FIG. 17A is a cross-sectional view taken along the line 17A—17A of FIG. 18 showing the connector engaged with the electrical contacts engaged.
Figure 17B:
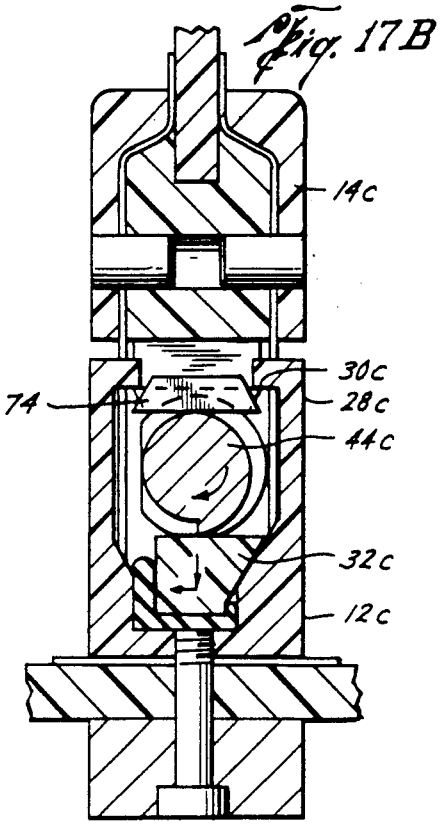
FIG. 17B is a cross-sectional view taken along the line 17B—17B of FIG. 18 showing the latching and unlatching mechanism in the same position as the parts of FIG. 17A.
Figure 18:
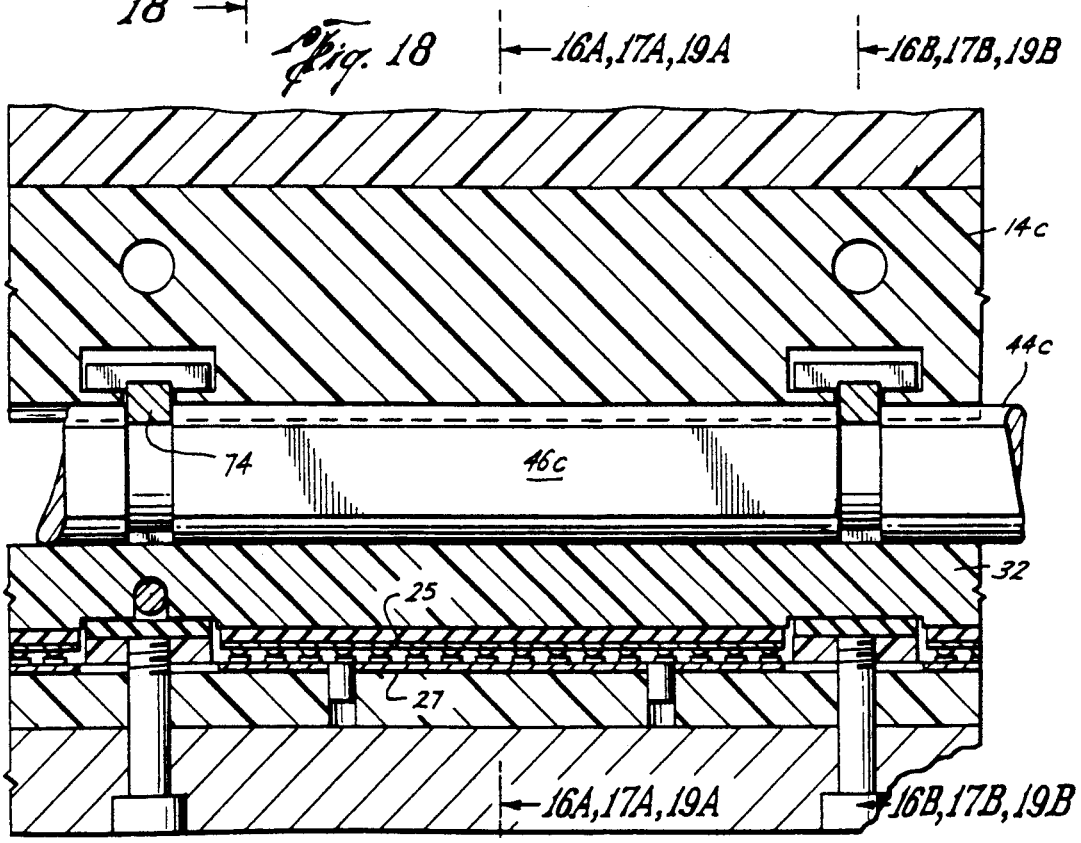
FIG. 18 is a cross-sectional view, taken along the line 18—18 of FIG. 17A.

The release means includes wedges 74 which are positioned in cam grooves 76 offset from the cam surfaces 46c and 48c which actuate the block 32c. The cam groove 76 does not effect the release movement of the wedges 74 when the wiping block 32c is being actuated, as best seen in FIGS. 16B and 17B. However, the cam groove 76 includes a cam lobe 78 which, upon counterclockwise movement of the cam 44c, as best seen in FIG. 19B, is brought into engagement with the wedges 74 for releasing the latch arms 28c from the latch shoulders 30c. Thereafter, the connector part 14c may be retrieved as the distance x of the opening 24c in part 12c is greater than the width of the wiping block 32c. It is also noted in FIG. 19A, in this particular embodiment, that the cam 44c maintains the wiping block 32c in compression while the wedges 74 are being acted upon to provide a backup support for releasing the wedges 74.

While the electrical contacts on the first connector part 12 and second connector part 14 may be of any suitable type, the connector of the present invention is particularly useful for using flexible circuit tapes, such as TAB tape, for providing the plurality of electrical contacts. Preferably, the modules 18a, 18b, 18c, 22a, 22b and 22c contain a flexible tape having an insulating layer 80, and a plurality of conductors or traces 82 and, if desired, a third ground layer (not shown in FIG. 2). For example, the insulator may be polyimide and the traces or conductors may be copper and may be conventionally manufactured by conventional phototooled procedures. Tolerance variations due to thermo-mechanical effects, or imprecise fabrication, must be taken into account in order to prevent any discrepancy in alignment between the modules 22a, 22b, and 22c with the modules 18a, 18b and 18c. The larger the footprint, that is, the width and number of contacts to be connected, the more pronounced will be the effect of any misalignment. In the present invention, the electrical contacts are modularized whereby the cumulatively excessive misalignment effects of a large footprint can be overcome. That is, this is accomplished by instead of combining all of the modules 22a, 22b and 22c into a single entity, the electrical contacts are provided in smaller subentity modules 22a, 22b and 22c to behave as independent subconnectors. For example, a large housing, containing a row of N contacts, can be replaced by a row of 10 independent modules, each containing a row of (1/10) N contacts aligned as in a large housing. If the modules are independent, that is, each having its own alignment reference point, the misalignment effects due to changes, such as in ambient temperature, can potentially be reduced to 10% of the misalignment characteristic of a single large entity.

FIGS. 1 and 2 illustrate an embodiment of the modular concept. A flexible circuit tape based upon a 35 millimeter frame format is used to provide an interconnect between a four-inch daughter board 20 and a mother board 16 in a card cage configuration. Three identical tapes are used on each board. Electrical connection is made to both sides of the daughter board edge 20 providing a total of 354 connections on a 0.015 inch pitch. Optional connector widths, by this design, are in increments of 118 contacts per 1.3 inches. The present practical pitch limit for flex circuit materials is about 0.004 inches. The upper limit of the design, for tape fabrication available today, is therefore about 450 contacts in a 1.3 inch module.

Each of the modules 22a, 22b and 22c, is designed to behave as an independent connector in that its interconnect tape is aligned independently of the other tapes in an adjacent module. This design principle of noncumulative tolerances is illustrated in FIG. 2, which shows the bottom of second part 14 in FIG. 1. This will also apply to FIG. 9 or the upper part of FIG. 15 as assembled. This alignment is conveniently accomplished by the use of a common reference point. As an example, referring to FIGS. 15, 16A and 19A, pin 70 acting as a reference in slot 72 aligns the upper block 32c to the first part 12c. As seen in FIG. 2, the guide pins 84 project through the modules 22a, 22b and 22c and align their contacts to the reference point at slot 72 in block 32, and thus to the corresponding contacts in modules 18a, 18b and 18c, respectively. Each of the three tape interconnection modules 22a, 22b and 22c are aligned in position only to the single contact reference line 86 shown. The modules 22a, 22b and 22c interconnects are not directly referenced to one another. Therefore, the tolerance variations (due to thermo-mechanical effects, imprecise fabrication, etc.) are only with respect to the single location or reference line 86. Thus, there are no cumulative tolerances to consider. The tapes 18a, 18b and 18c on the mother board 16 are aligned in a similar manner.

Figure 20:
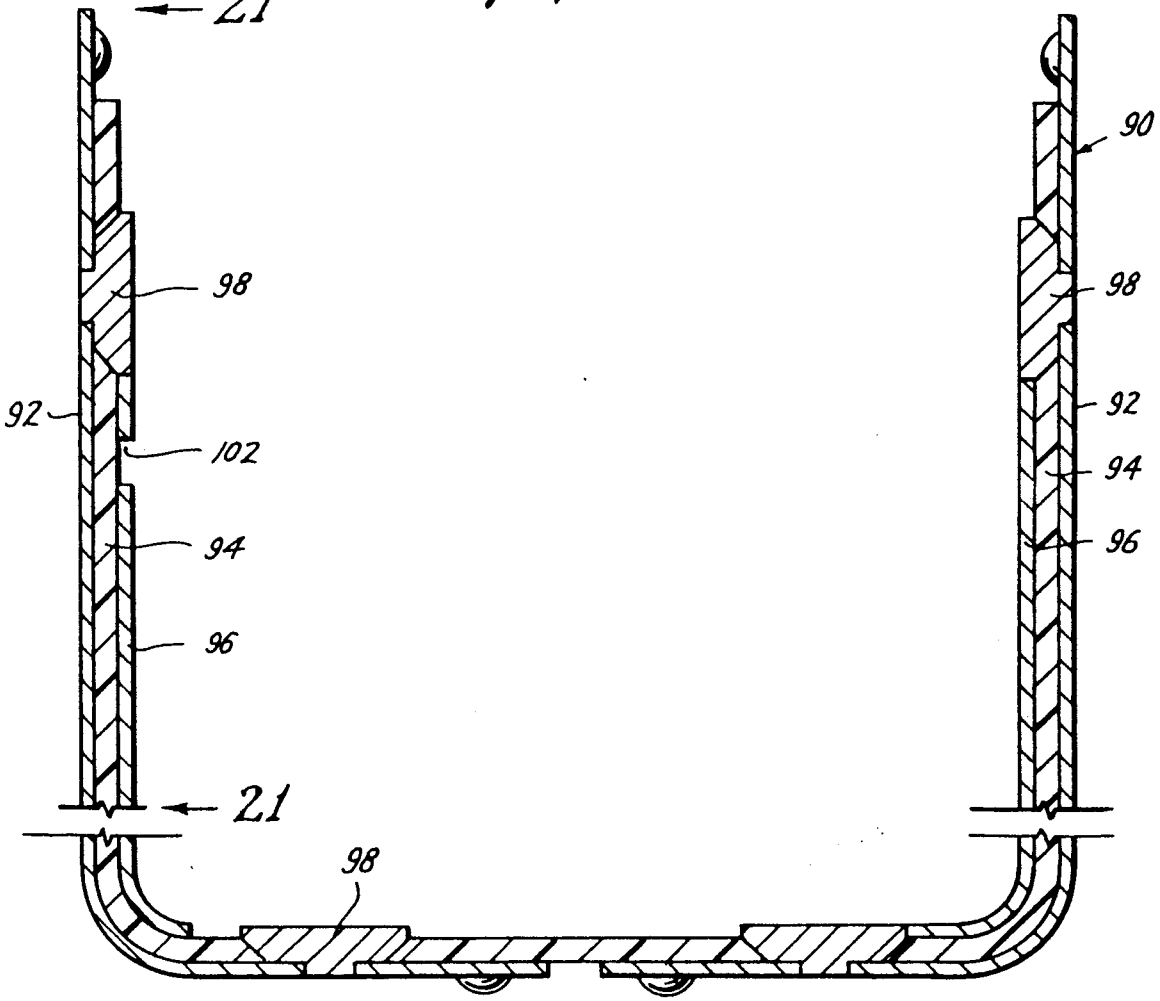
FIG. 20 is an enlarged fragmentary, cross-sectional view illustrating one form of the electrical contact of the present invention.
Figure 21:
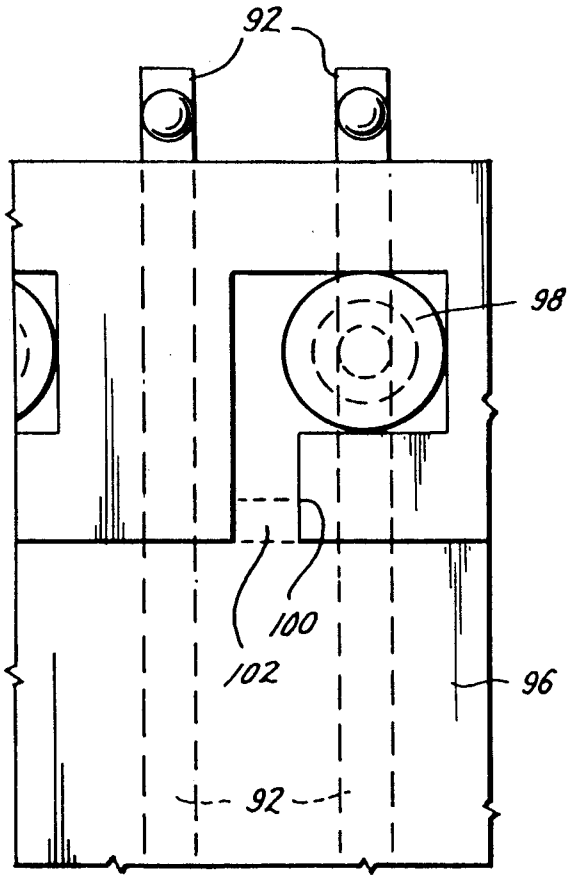
FIG. 21 is a cross-sectional view taken along the line 21—21 of FIG. 20.

Another feature of the present invention is the provision of electrical contacts using flexible circuit tape for the modules 22a, 22b, 22c, 18a, 18b and 18c. Referring now to FIGS. 20 and 21, a flexible electrical interconnect tape 90 is provided having three layers in which the first layer includes a plurality of electrical traces 92, the second layer is the middle layer and includes an insulator 94 and the third layer includes a metal ground layer 96. Such a structure is conventional. The ground layer 96, however, is optional and may not be necessary in certain applications. A portion of the connections in each tape module may be required for ground returns. The ratio of signal/ground return required will vary according to the application and construction of the tape. One feature of the present flexible tape is to provide the end user the capability to program the signal/ground ratio of the interconnect according to the application requirements. The traces 92 and the ground layer 96 may be of copper and the insulator 94 may be a suitable polymer film, such as polyimide. Near the ends of electrical traces 92, alternate traces 92 are connected by conductive vias 98 through the insulator layer 94 to the ground plane 96 by means of a connection 100. The tape 90 is manufactured by providing the vias 98 to be filled during tape fabrication by a process compatible with the manufacture of the tape 90 such as but not limited to plating or electroforming. Since the alternate traces 92 are connected to the ground plane 96, without end user alteration, the tape interconnect as manufactured provides a 1:1 signal to ground ratio. However, the present structure allows the end user to alter the signal to ground ratio. However, the present structure allows the end user to alter the signal to ground ratio by removing the connection 100, shown as removed region 102, as desired between the via 98 and the ground plane 96. Preferably, the connection 100 is offset from the ground plane 96 to provide a small conductor which may be easily removed by laser milling, chemical etching, or mechanical abrasion. Preferably, the offset 100 is offset from the traces 92 on the first layer and may easily punched out or severed through the insulator layer 94 without affecting the signal traces. For 0.004 inch wide traces on 0.15 inch centers, the signal to ground ratio may range from 1:1 to about 60:1 for a parallel array of traces arranged longitudinally on a tape one inch in width.

The present invention, therefore, is well adapted to carry out the objects and attain the ends and advantages mentioned as well as others inherent therein. While presently preferred embodiments of the invention have been given for the purpose of disclosure, numerous changes in the details of construction and arrangement of parts will be readily apparent to those skilled in the art and which are encompassed within the spirit of the invention and the scope of the appended claims.

What is claimed is:

1. An electrical connector having first and second coacting engagable and releasable longitudinally extending parts, each of said parts including a plurality of spaced electrical contacts for connection to the contacts on the other part comprising, a latching and unlatching mechanism connected between the first and second parts and positioned on each side of the plurality of contacts, said mechanism including latching arms on one part and latch shoulders on the other part, a longitudinally extending loading and wiping block extending through the second part adjacent the electrical contacts on the second part and extending through the latching and unlatching mechanisms, coacting incline surfaces in the latching and unlatching mechanisms between the loading and wiping block and the first part for moving the block transversely as it is moved toward the contacts, rotatable cam means between the block and said second part for moving the block toward the contacts, and release means engagable with and unlatching the latching arms from the latch shoulders.

2. The apparatus of claim 1 wherein the release means includes a release wedge and the cam means includes first and second cam surfaces, one of said surfaces controlling the movement of the loading and wiping block and the second controlling the movement of the release wedge.

3. The apparatus of claim 1 including, biasing means positioned between the first part and the loading and wiping block for biasing the coacting incline surfaces together for creating a wiping action between contacts on the first and second parts.

4. The apparatus of claim 1 wherein the electrical contacts on each part include a flexible tape having an insulating layer and a plurality of conductors.

5. The apparatus of claim 4 wherein the flexible tape on the second part extends around the loading and wiping block and is attached to opposite sides of the second part.

6. The apparatus of claim 1 wherein the electrical contacts on each of the parts includes a plurality of modules, each module including a plurality of electrical contacts, each module including a flexible tape having an insulating and a metal contact layer, and each module having an independent alignment reference point on its connected part for avoiding cumulative alignment errors.

7. The apparatus of claim 1 wherein at least one of the parts comprises, a flexible electrical tape having two layers, the first layer includes a plurality of electrical traces, and the second layer including an insulator.

8. The apparatus of claim 1 wherein at least one of the parts comprises, a flexible electrical tape having three layers, the first layer includes a plurality of electrical traces, the second layer is the middle layer and includes an insulator, and the third layer includes a ground layer.

9. The apparatus of claim 8 including a connection between alternate traces through a via in the insulator to the ground layer, and said connection to the ground layer being in the third layer and includes a portion offset from the ground layer.

10. The apparatus of claim 8 including a connection between alternate traces through a via in the insulator to the ground layer, and said connection to the ground layer being in the third layer and includes a portion offset from the electrical traces.

11. The apparatus of claim 1 wherein the release means includes a longitudinally extending wedge member movable in a longitudinal direction for simultaneously releasing all of the latching arms.

12. An electrical connector comprising, first and second coacting engagable and releasable longitudinally extending parts, said first part having an opening for receiving said second part, said first part having a window in which are positioned a plurality of spaced electrical contacts, said second part including a plurality of spaced electrical contacts extending around the bottom of the second part and attached to opposite sides of the second part, the contacts on the second part positioned to engage the contacts on the first part when the second part is positioned in the opening of the first part, a latching and unlatching mechanism connected between the first and second parts and positioned on each side of the plurality of contacts, said mechanism including latching arms on one part and latch shoulders on the other part, a longitudinally extending loading and wiping block extending through the second part against the electrical contacts on the second part and extending through the latching and unlatching mechanisms, coacting incline surfaces in the latching and unlatching mechanism between the loading and wiping block and the first part for moving the block transversely to the longitudinal axis of the parts as it is moved toward the contacts, rotatable cam means between the block and said second part for moving the block toward the contacts, and release means engagable with and unlatching the latching arms from the latch shoulders.

13. The apparatus of claim 12 wherein the release means includes a release wedge and the cam means includes first and second cam surfaces, one of said surfaces controlling the movement of the loading and wiping block and the second controlling the movement of the release wedge.

14. The apparatus of claim 12 including, biasing means positioned between the first part and the loading and wiping block for biasing the coacting incline surfaces together for creating a wiping action between contacts on the first and second parts.

15. The apparatus of claim 12 wherein the electrical contacts on each part include a flexible tape having an insulating layer and a plurality of conductors.

16. The apparatus of claim 15 wherein the flexible tape on the second part extends around the loading and wiping block and is attached to opposite sides of the second part.

17. The apparatus of claim 12 wherein the electrical contacts on each of the parts includes a plurality of modules, each module including a plurality of electrical contacts, each module including a flexible tape having an insulating and a metal contact layer, and each module having an independent alignment reference point on its connected part for avoiding cumulative alignment errors.

18. The apparatus of claim 12 wherein at least one of the parts comprises, a flexible electrical tape having three layers, the first layer includes a plurality of electrical traces, the second layer is the middle layer and includes an insulator, and the third layer includes a ground layer.

19. The apparatus of claim 18 including a connection between alternate traces through a via in the insulator to the ground layer, and said connection to the ground layer being in the third layer and extending from the ground layer to the conductive via for ease of removal for changing the signal to ground ratio.

20. The apparatus of claim 18 including a connection between alternate traces through a via in the insulator to the ground layer, and said connection to the ground layer being in the third layer and includes a portion offset from the electrical traces.

21. The apparatus of claim 12 wherein the release means includes a longitudinally extending wedge member movable in a longitudinal direction for simultaneously releasing all of the latching arms.

22. A flexible electrical interconnect tape having three layers comprising, the first layer includes a plurality of electrical traces, the second layer is the middle layer and includes an insulator, and the third layer includes a metal ground layer, a conductive via connected to alternate traces and extending through the insulator to the third layer, and a connection in the third layer between each via and the ground layer and said connection extending from the ground layer to the conductive via for ease of removal for changing the signal to ground ratio.

23. A flexible electrical interconnect tape having three layers comprising, the first layer includes a plurality of electrical traces, and second layer is the middle layer and includes an insulator, and the third layer includes a metal ground layer, a conductive via connected to alternate traces through the insulator to the third layer, and a connection in the third layer between each via and the ground layer and said connection extending from the ground layer to the conductive via for ease of removal for changing the signal to ground ratio and including a portion offset from the electrical traces.

* * * * *